US008844168B2

(12) United States Patent
Toraya

(10) Patent No.: US 8,844,168 B2
(45) Date of Patent: Sep. 30, 2014

(54) FOOTWEAR LACING SYSTEM

(75) Inventor: Erin Elizabeth Toraya, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 97 days.

(21) Appl. No.: 13/267,515

(22) Filed: Oct. 6, 2011

(65) Prior Publication Data

US 2013/0086815 A1 Apr. 11, 2013

(51) Int. Cl.

| | |
|---|---|
| ***A43C 11/00*** | (2006.01) |
| ***A43C 1/00*** | (2006.01) |
| ***A43C 7/00*** | (2006.01) |

(52) U.S. Cl.

CPC ... *A43C 1/00* (2013.01); *A43C 7/00* (2013.01); *A43C 7/005* (2013.01); *A43C 1/006* (2013.01)

USPC ..... 36/50.1; 36/50.5; 24/712; 24/713.4

(58) Field of Classification Search

USPC ..... 36/50.1, 50.5; 24/712, 713.4

See application file for complete search history.

(56) References Cited

U.S. PATENT DOCUMENTS

| | | | | |
|---|---|---|---|---|
| 716,528 | A | | 12/1902 | Flowers |
| 879,272 | A | | 2/1908 | Key |
| 1,340,503 | A | | 5/1920 | Schopper |
| 3,458,368 | A | | 7/1969 | Haberecht |
| 3,526,977 | A | | 9/1970 | Partagas |
| 3,546,796 | A | | 12/1970 | Adams |
| 3,548,798 | A | | 12/1970 | Fleischer et al. |
| 3,703,775 | A | | 11/1972 | Gatti |
| 3,710,486 | A | | 1/1973 | Revny |
| 3,837,098 | A | | 9/1974 | Rathmell |
| 3,934,346 | A | | 1/1976 | Sasaki et al. |
| 4,200,998 | A | | 5/1980 | Adams |
| 4,282,659 | A | | 8/1981 | Bourque et al. |
| RE31,052 | E | | 10/1982 | Adams |
| 4,442,613 | A | | 4/1984 | Dobbin |
| 4,458,373 | A | | 7/1984 | Maslow |
| 4,547,981 | A | | 10/1985 | Thais et al. |
| 4,622,763 | A | | 11/1986 | Adams |
| 4,856,207 | A | * | 8/1989 | Datson ..... 36/2 R |
| 4,942,678 | A | | 7/1990 | Gumbert |
| 4,972,609 | A | | 11/1990 | Oh et al. |
| 4,972,613 | A | | 11/1990 | Loveder |
| 5,158,428 | A | | 10/1992 | Gessner et al. |
| 5,291,671 | A | | 3/1994 | Caberlotto et al. |
| 5,371,957 | A | | 12/1994 | Gaudio |
| 5,511,325 | A | | 4/1996 | Hieblinger |
| 5,657,557 | A | | 8/1997 | Hull et al. |

(Continued)

FOREIGN PATENT DOCUMENTS

| | | |
|---|---|---|
| WO | 0035308 | 6/2000 |

*Primary Examiner* — Khoa Huynh
*Assistant Examiner* — Katharine Gracz
(74) *Attorney, Agent, or Firm* — Plumsea Law Group, LLC

(57) ABSTRACT

A lacing system for an article of footwear may include a lateral series of lace-receiving elements and a medial series of lace-receiving elements. A first lace extends consecutively through a first lateral lace-receiving element, a second lateral lace-receiving element, a fourth medial lace-receiving element, a fifth lateral lace-receiving element, a third medial lace-receiving element, and again through the first lateral lace-receiving element. A second lace extends consecutively through a first medial lace-receiving element, a second medial lace-receiving element, a fourth lateral lace-receiving element, a fifth medial lace-receiving element, a third lateral lace-receiving element, and again through the first medial lace-receiving element.

18 Claims, 11 Drawing Sheets

(56) References Cited

U.S. PATENT DOCUMENTS

| | | | | |
|---|---|---|---|---|
| D385,043 | S | 10/1997 | Worthington | |
| 5,678,325 | A | 10/1997 | Davidowitz et al. | |
| 5,755,044 | A | 5/1998 | Veylupek | |
| 5,884,419 | A | 3/1999 | Davidowitz et al. | |
| 5,943,793 | A | 8/1999 | Clements | |
| 6,088,936 | A | 7/2000 | Bahl | |
| 6,192,559 | B1 | 2/2001 | Munsell, Jr. | |
| 6,282,817 | B1 | 9/2001 | Curet | |
| 6,286,233 | B1 | 9/2001 | Gaither | |
| 6,338,186 | B1 | 1/2002 | Kleinmann | |
| 6,370,743 | B2 | 4/2002 | Choe | |
| 6,502,329 | B1 | 1/2003 | Silagy | |
| 6,532,688 | B2 | 3/2003 | Bouvier | |
| 6,823,610 | B1 | 11/2004 | Ashley | |
| 6,941,683 | B2 * | 9/2005 | Freed | 36/50.1 |
| 6,952,890 | B1 | 10/2005 | Blakeslee | |
| 7,908,769 | B2 | 3/2011 | Pellegrini | |
| 2002/0002781 | A1 | 1/2002 | Bouvier | |
| 2003/0051374 | A1 | 3/2003 | Freed | |

* cited by examiner

FOOTWEAR LACING SYSTEM

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

SUMMARY

In one aspect, a lacing system for an article of footwear may have a first series of lace-receiving elements extending in a longitudinal direction of the footwear. The lacing system may also have a second series of lace-receiving elements extending in the longitudinal direction of the footwear, the second series being spaced from the first series. A first lace extends through (a) two of the lace-receiving elements of the first series that are consecutive and (b) two of the lace-receiving elements of the second series that are consecutive. Additionally, a second lace extends through (a) two of the lace-receiving elements of the second series that are consecutive and (b) two of the lace-receiving elements of the first series that are consecutive.

In another aspect, a lacing system for an article of footwear may have a first series of lace-receiving elements extending in a longitudinal direction of the footwear. The lacing system may also have a second series of lace-receiving elements extending in the longitudinal direction of the footwear, the second series being spaced from the first series. A first lace extends through three of the lace-receiving elements of the first series and two of the lace-receiving elements of the second series. Additionally, a second lace extends through three of the lace-receiving elements of the second series and two of the lace-receiving elements of the first series.

In yet another aspect, a lacing system for an article of footwear may include a plurality of lace-receiving elements. A first lace has two first end lengths and a first central length. The first end lengths are parallel and joined to each other. The first central length is located between the first end lengths and forms a first loop. The first central length extends through a first set of the lace-receiving elements. A second lace has two second end lengths and a second central length. The second end lengths are parallel and joined to each other. The second central length is located between the second end lengths and forms a second loop. The second central length extends through a second set of the lace-receiving elements.

In a further aspect, a lacing system for an article of footwear may include a plurality of lace-receiving elements. The lace-receiving elements extend through a throat area of the upper and include (a) a first lace-receiving element positioned proximal to an ankle opening of the upper and (b) a second lace-receiving element that is spaced from the first lace-receiving element and positioned proximal to the ankle opening. A first lace extends through a portion of the lace-receiving elements, and two segments of the first lace extend through the first lace-receiving element. A second lace extends through another portion of the lace-receiving elements, and two segments of the second lace extend through the second lace-receiving element.

In another aspect, a lacing system for an article of footwear may include a lateral series of lace-receiving elements and a medial series of lace-receiving elements. The lateral series is located in a lateral portion of the footwear and includes a first lateral lace-receiving element positioned proximal to an ankle opening of the upper, a second lateral lace-receiving element positioned forward of the first lateral lace-receiving element, a third lateral lace-receiving element positioned forward of the second lateral lace-receiving element, a fourth lateral lace-receiving element positioned forward of the third lateral lace-receiving element, and a fifth lateral lace-receiving element positioned forward of the fourth lateral lace-receiving element. The medial series is located in a medial portion of the footwear and includes a first medial lace-receiving element positioned proximal to an ankle opening of the upper, a second medial lace-receiving element positioned forward of the first medial lace-receiving element, a third medial lace-receiving element positioned forward of the second medial lace-receiving element, a fourth medial lace-receiving element positioned forward of the third medial lace-receiving element, and a fifth medial lace-receiving element positioned forward of the fourth medial lace-receiving element. A first lace extends consecutively through the first lateral lace-receiving element, the second lateral lace-receiving element, the fourth medial lace-receiving element, the fifth lateral lace-receiving element, the third medial lace-receiving element, and the first lateral lace-receiving element. A second lace extends consecutively through the first medial lace-receiving element, the second medial lace-receiving element, the fourth lateral lace-receiving element, the fifth medial lace-receiving element, the third lateral lace-receiving element, and the first medial lace-receiving element.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose a lacing system for an article of footwear. The article of footwear is presented as having a general configuration suitable for walking or running. Concepts associated with the footwear, may also be applied to a variety of other athletic footwear types, including baseball shoes, basketball shoes, cross-training shoes, cycling shoes, football shoes, tennis shoes, and soccer shoes, for example. The concepts may also be applied to footwear types that are generally considered to be non-athletic, including dress shoes, loafers, and boots. The concepts disclosed herein apply, therefore, to a wide variety of footwear types and are not limited to the various configurations presented herein.

General Footwear Structure

Figure 1:
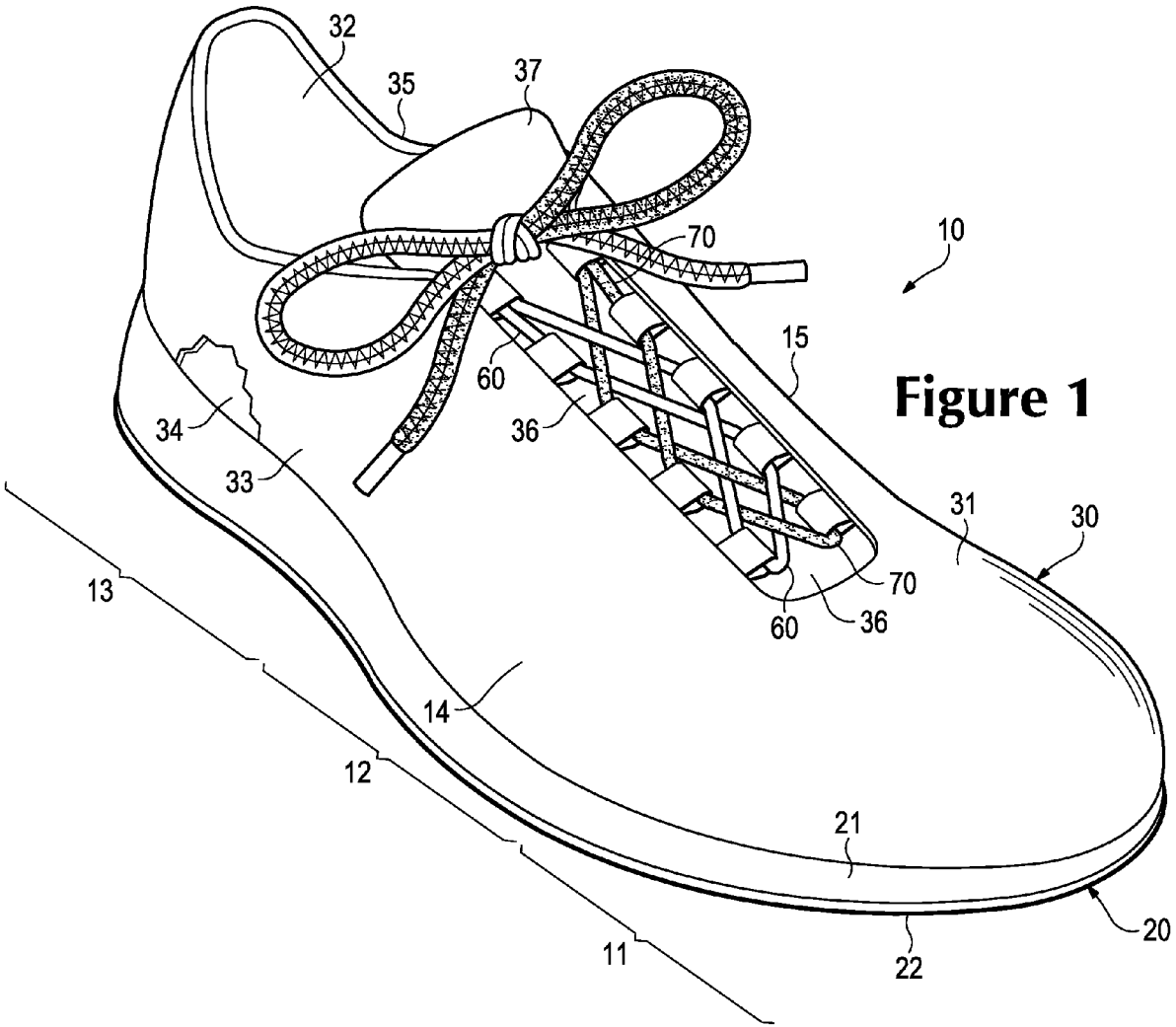
FIG. 1 is a perspective view of an article of footwear.

An article of footwear 10 is depicted in FIG. 1 as including a sole structure 20 and an upper 30. Sole structure 20 is secured to a lower area of upper 30 and extends between upper 30 and the ground. Upper 30 provides a comfortable and secure covering for a foot of a wearer. As such, the foot may be located within upper 30, which effectively secures the foot within footwear 10, and sole structure 20 extends under the foot to, for example, attenuate forces, enhance stability, or influence the motions of the foot.

For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Figure 4:
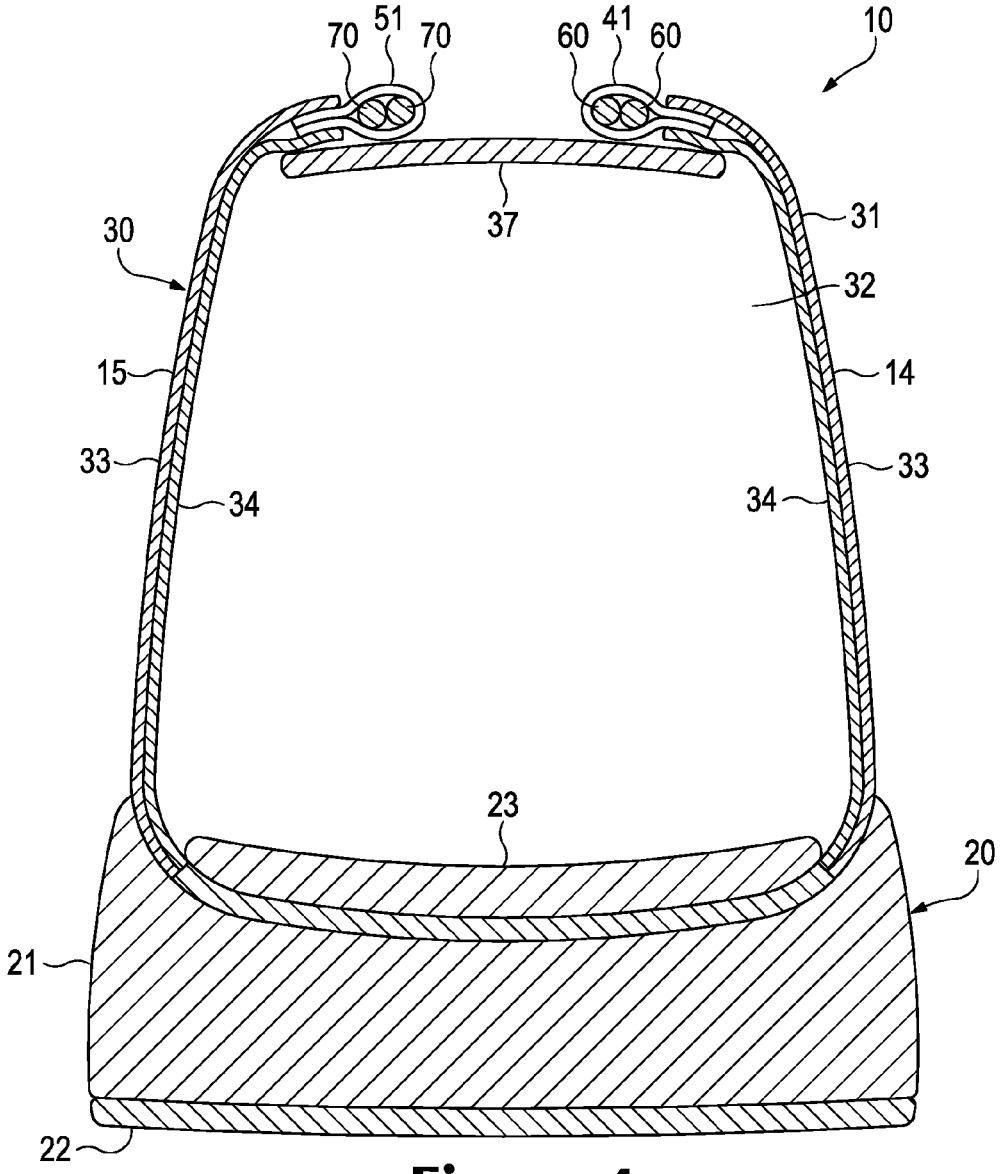
FIG. 4 is a cross-sectional view of the article of footwear, as defined by section line 4 in FIG. 3.
Figure 5:
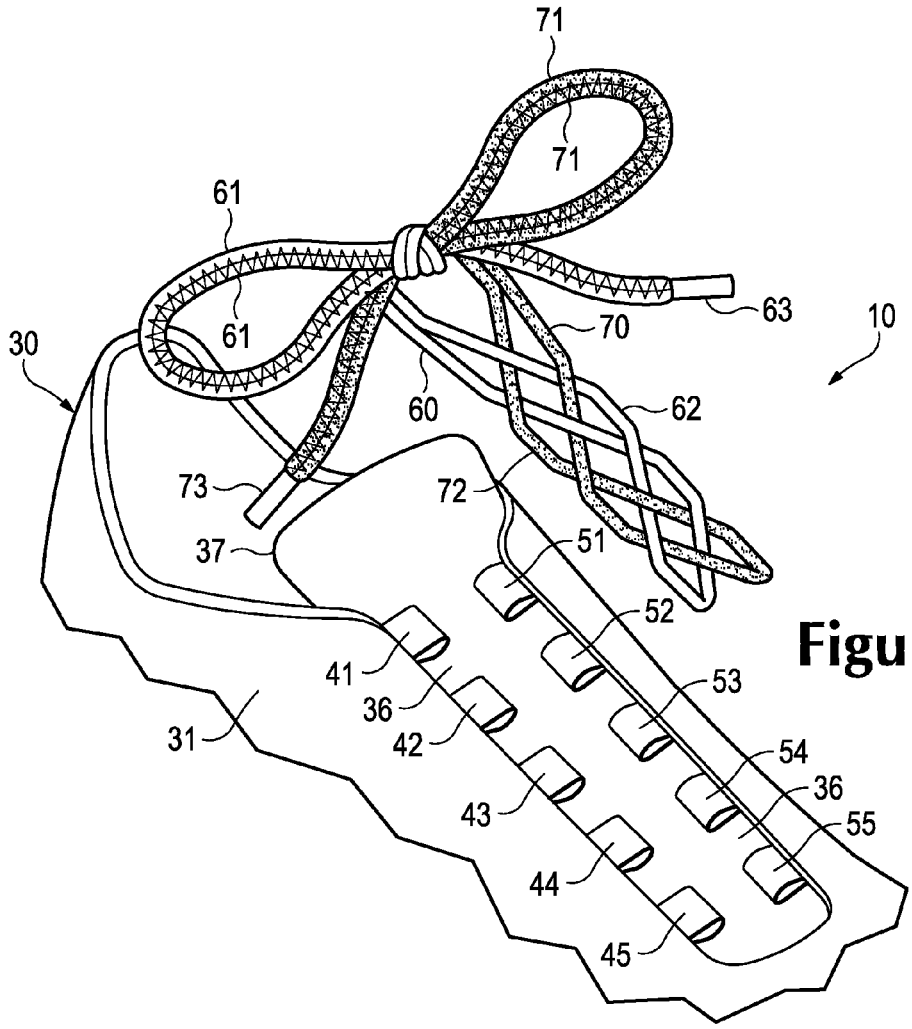
FIG. 5 is an exploded partial perspective view of the article of footwear.

Sole structure 20 includes a midsole 21, an outsole 22, and an sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30, as depicted in FIG. 4, and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30, as noted above, is secured to sole structure 20 and provides a comfortable and secure covering for a foot of a wearer. A majority of upper 30 is formed from a covering element 31 that defines a portion of a void 32 within upper 30. Void 32 is a generally hollow area of footwear 10 that has a general shape of the foot and is intended to receive the foot. Covering element 31 extends (a) along a portion of void 32 in lateral side 14, (b) along a portion of void 32 in medial side 15, (c) over void 32 in a forefoot region 11, and (d) around void 32 in heel region 13. As such, covering element 31 effectively provides a covering for the foot. The various portions of covering element 31 may be formed from one or more of a plurality of material elements (e.g., textiles, polymer sheet layers, polymer foam layers, leather, synthetic leather) that are stitched or bonded together. Referring to FIG. 4, for example, covering element 31 includes an exterior layer 33 and an adjacent interior layer 34 that may be formed from any of the materials noted above. Whereas exterior layer 33 forms an exterior surface of upper 30, interior layer 34 is located inward of exterior layer 32 and forms an interior surface of upper 30, thereby defining a portion of void 32. Additionally, an upper edge of covering element 31 defines an ankle opening 35 in at least heel region 13 for providing the foot with access to void 34. In further configurations, covering element 31 may include (a) one or more additional layers, such as a central foam layer, (b) a heel counter that stabilizes a heel of the foot in heel region 13, or (c) a wear-resistant toe guard located in forefoot region 11. Although not depicted, indicia in the form of trademarks, for example, aesthetic features, and material and care information may also be secured to or printed on covering element 31 or other elements of upper 30.

Figure 2:
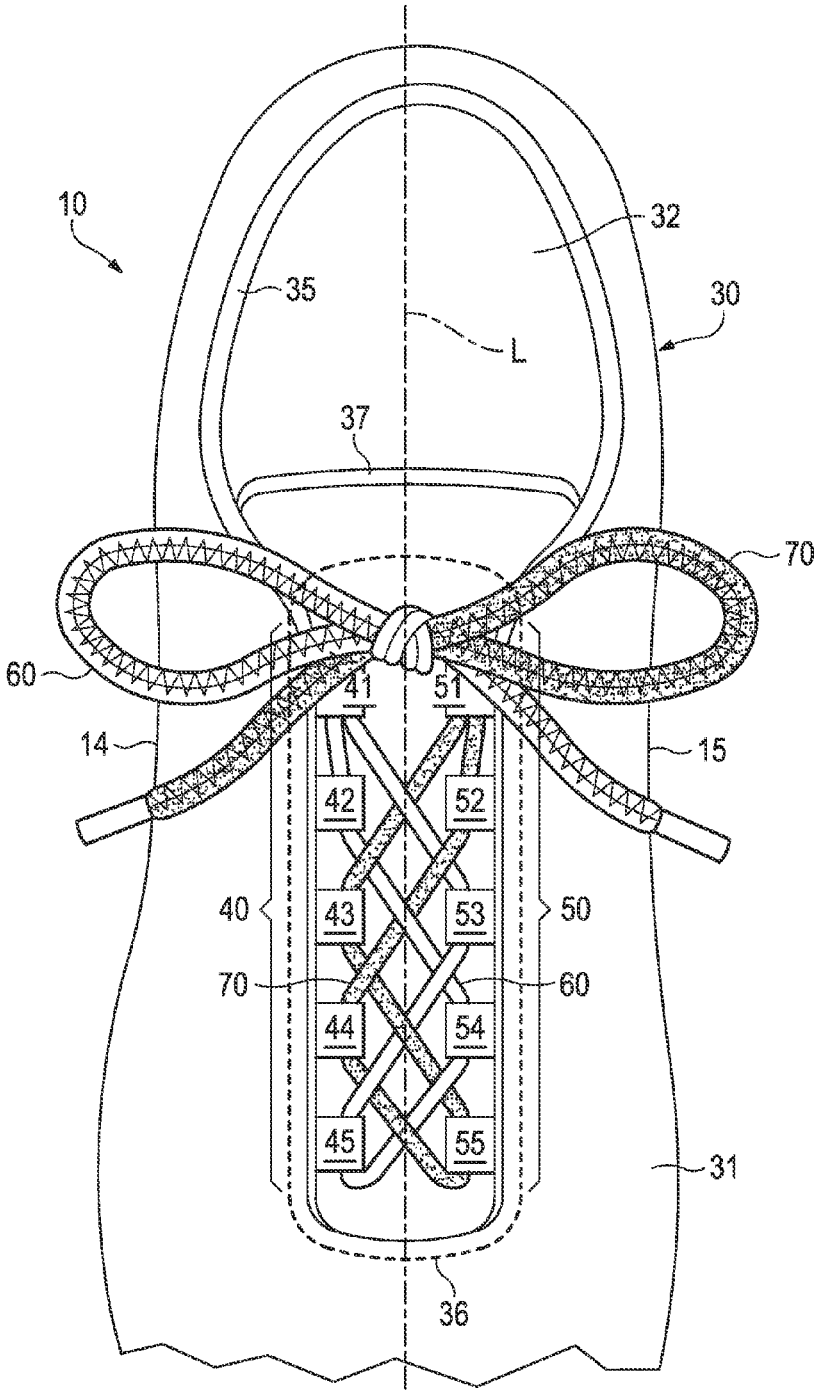
FIG. 2 is a top plan view of the article of footwear.
Figure 3:
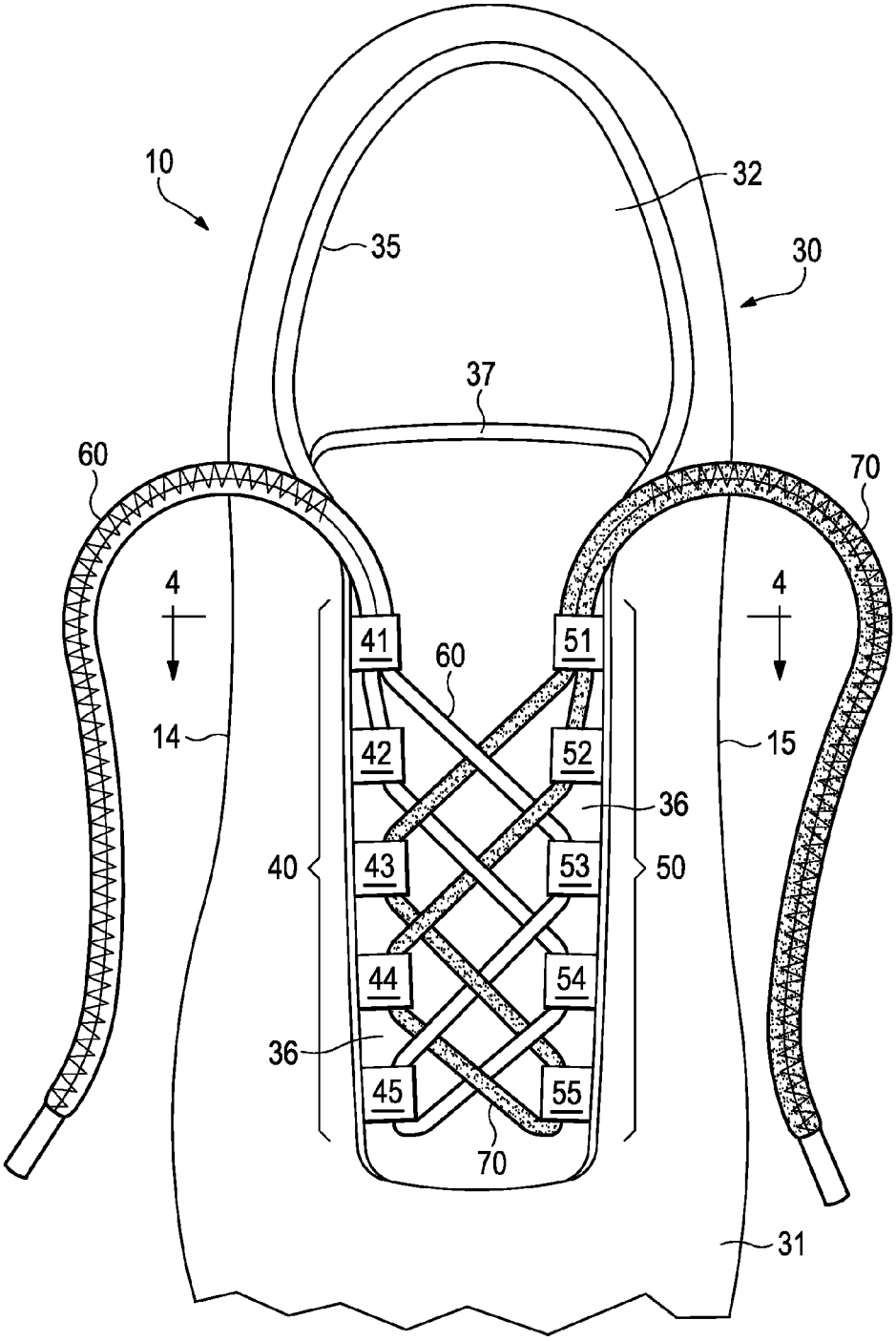
FIG. 3 is another top plan view of the article of footwear.

A portion of upper 30 that covers an instep of the foot includes a throat area 36 that is located in at least midfoot region 12. Although the extent of throat area 36 may vary depending upon the construction and style of footwear 10, throat area 36 generally extends between forefoot region 11 (or a forward area of midfoot region 12) and ankle opening 35, as shown in FIG. 2. In addition to a lacing system, which will be described in detail below, throat area 36 includes a tongue 37 that extends longitudinally (i.e. in a direction corresponding with a longitudinal axis L of footwear 10 that passes through each of regions 11-13) through throat area 36. A lower surface of tongue 37 forms a portion of void 32 and contacts the foot when footwear 10 is worn. In some configurations, tongue 37 is secured to upper 30 in a forward portion of throat area 36. Although tongue 37 may have a variety of configurations, tongue 37 may be formed from a foam material that is surrounded by an exterior textile sheath, for example.

Lacing System Configuration

Upper 30 has a lacing system that includes a lateral series 40 of five lace-receiving elements 41-45, a medial series 50 of five lace-receiving elements 51-55, a first lace 60, and a second lace 70. The lacing system provides a wearer with the ability to selectively modify the dimensions of upper 30. More particularly, the wearer may utilize the lacing system to (a) enlarge the dimensions of void 32 and ankle opening 35 when placing footwear 10 upon the foot and removing footwear 10 from the foot and (b) decrease the dimensions of void 32 and ankle opening 35 to tighten upper 30 around the foot.

Lateral series 40 includes the various lace-receiving elements 41-45 and extends longitudinally through a portion of throat area 36 that generally corresponds with lateral side 14. Lace-receiving elements 41-45 are successively positioned on upper 30. More particularly, lace-receiving element 41 is located proximal to ankle opening 35 and rearward of the other lace-receiving elements 42-45, lace-receiving element 42 is positioned forward of lace-receiving element 41, lace-receiving element 43 is positioned forward of lace-receiving element 42, lace-receiving element 44 is positioned forward of lace-receiving element 43, and lace-receiving element 45 is positioned forward of lace-receiving element 44 and proximal to a forward portion of throat area 36. Lace-receiving element 41 may be the topmost lace-receiving element of lateral series 40 and lace-receiving element 45 may be the bottommost lace-receiving element of lateral series 40.

Medial series 50 includes the various lace-receiving elements 51-55 and extends longitudinally through a portion of throat area 36 that generally corresponds with medial side 15. As such, lateral series 40 and medial series 50 are spaced from each other across a portion of throat area 36 where tongue 37 is exposed. Lace-receiving elements 51-55 are successively positioned on upper 30. More particularly, lace-receiving element 51 is located proximal to ankle opening 35 and rearward of the other lace-receiving elements 52-55, lace-receiving element 52 is positioned forward of lace-receiving element 51, lace-receiving element 53 is positioned forward of lace-receiving element 52, lace-receiving element 54 is positioned forward of lace-receiving element 53, and lace-receiving element 55 is positioned forward of lace-receiving element 54 and proximal to a forward portion of throat area 36. Lace-receiving element 51 may be the topmost lace-receiving element of medial series 50 and lace-receiving element 55 may be the bottommost lace-receiving element of medial series 50.

Each of lace-receiving elements 41-45 and 51-55 are formed as a tubular structure with an axis extending in the longitudinal direction of footwear 10. As an example of the manner in which this tubular structure may be formed, each of lace-receiving elements 41-45 and 51-55 may have the configuration of a folded material element, as depicted in FIG. 4, with ends that are secured between layers 33 and 34. As alternatives, one or more of lace-receiving elements 41-45 and 51-55 may be another structure that is suitable for receiving one of laces 60 and 70, such as an aperture in covering element 31, a tubular structure, a D-ring, or a hook.

Laces 60 and 70 may be formed from conventional materials utilized in footwear laces. Moreover, laces 60 and 70 may be formed from any of a variety of elongate and flexible elements, such as a cord, rope, twine, filament, cable, thread, or yarn, for example. Although laces 60 and 70 are depicted as having a generally circular cross-sectional shape, laces 60 and 70 may also have an elongate, compressed, or otherwise non-circular shape.

Each of laces 60 and 70 pass through selected lace-receiving elements 41-45 and 51-55. The specific manner in which laces 60 and 70 are routed through the various lace-receiving elements 41-45 and 51-55 may be viewed in FIGS. 1, 2, 3, and 5. As depicted, first lace 60 extends consecutively (i.e., in order) through lace-receiving element 41, lace-receiving element 42, lace-receiving element 54, the lace-receiving element 45, lace-receiving element 53, and again through lace-receiving element 41. Given this routing, first lace 60 passes twice through lace-receiving element 41, but only passes once through each of lace-receiving elements 42, 45, 53, and 54. That is, two segments (i.e., separate sections or portions) of first lace 60 extend through lace-receiving element 41. Another feature of this routing is that first lace 60 extends through (a) two consecutive lace-receiving elements 41 and 42 of lateral series 40 and (b) two consecutive lace-receiving elements 53 and 54 of medial series 50. Furthermore, a feature of this routing is that first lace 60 extends through three lace-receiving elements 41, 42, and 45 of lateral series 40 and two lace-receiving elements 53 and 54 of medial series 50.

Second lace 70 is routed similarly to first lace 60, but exhibits a reversed or mirror-image routing. More specifically, second lace 70 extends consecutively (i.e., in order) through lace-receiving element 51, lace-receiving element 52, lace-receiving element 44, lace-receiving element 55, lace-receiving element 53, and again through lace-receiving element 51. Given this routing, second lace 70 passes twice through lace-receiving element 51, but only passes once through each of lace-receiving elements 43, 44, 52, and 55. That is, two segments (i.e., separate sections or portions) of second lace 70 extend through lace-receiving element 51. Another feature of this routing is that second lace 70 extends through (a) two consecutive lace-receiving elements 51 and 52 of medial series 50 and (b) two consecutive lace-receiving elements 43 and 44 of lateral series 40. Furthermore, a feature of this routing is that second lace 70 extends through three lace-receiving elements 51, 52, and 55 of medial series 50 and two lace-receiving elements 43 and 44 of lateral series 40.

Although lateral series 40 and medial series 50 are discussed above and depicted as extending longitudinally through portions of throat area 36 that respectively correspond with lateral side 14 and medial side 15, lateral series 40 and medial series 50 may not be restricted to this configuration. As an example, lateral series 40 and medial series 50 may curve toward lateral side 14 or may be positioned on lateral side 14. In general, however, lateral series 40 will be positioned more toward lateral side 14 than medial series 50, and medial series 50 will be positioned more toward medial side 15 than lateral series 40.

Figure 6:
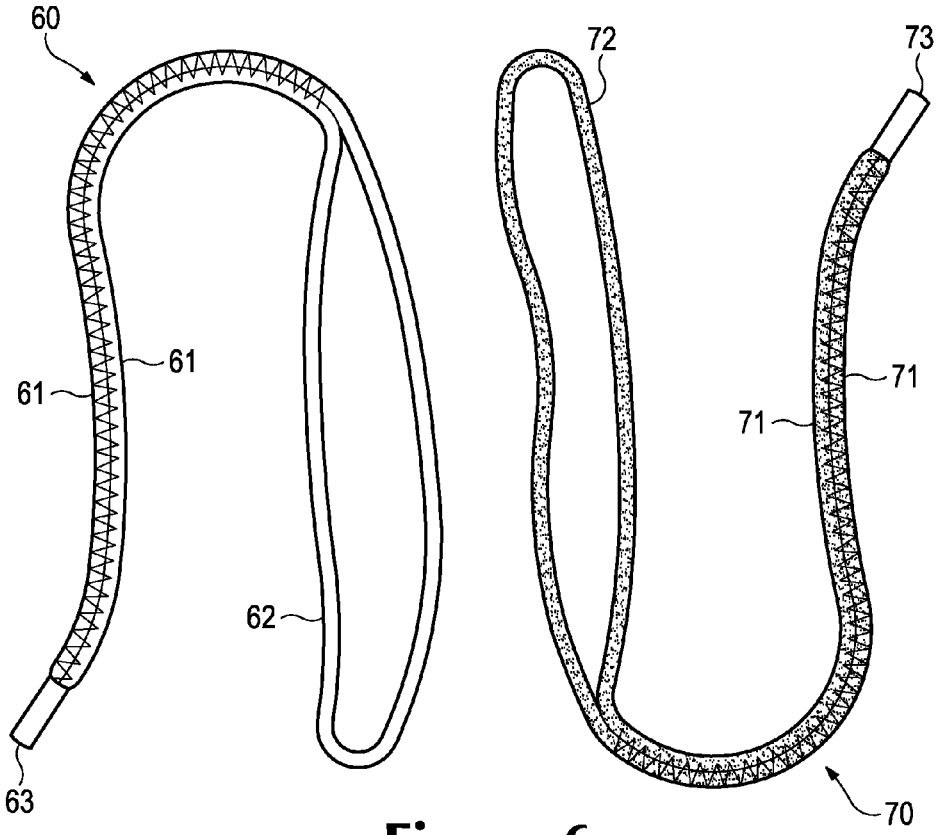
FIG. 6 is a top plan view of a pair of laces from the article of footwear.

When separated from a remainder of footwear 10, laces 60 and 70 exhibit the configuration depicted in FIG. 6. First lace 60 is generally formed from a single element of cord, for example, that is folded back upon itself and joined. More particularly, first lace 60 has two end lengths 61 and a central length 62. End lengths 61 are parallel and joined to each other. More particularly, end lengths 61 may be joined to each other to form a unitary segment. As shown in FIG. 6, end lengths 61 may be joined together by stitching to form a unitary segment. Although depicted as being joined with stitching, end lengths 61 may also be joined with an adhesive, thermal bonding, staples, or braiding, for example. That is, a variety of mechanical or chemical methods may be utilized to join end lengths 61. Central length 62 forms a loop. First lace 60 also includes a terminal end 63 at the terminus or extremities of end lengths 61 that is opposite central length 62. Second lace 70 has a similar configuration that includes two end lengths 71, a central length 72, and a terminal end 73. When incorporated into footwear 10, end lengths 61 and 71 may be tied together (or otherwise secured) or untied, as respectively depicted in FIGS. 2 and 3, to modify the dimensions of upper 30, whereas central lengths 62 and 72 generally pass through the various lace-receiving elements 41-45 and 51-55 in the routing discussed above. Based upon the discussion above, central length 62 passes through a set that includes lace-receiving elements 41, 42, 45, 53, and 54 and central length 72 passes through a set that includes lace-receiving elements 43, 44, 51, 52, and 55.

In some conventional articles of footwear, tensioning a lace involves simultaneously pulling on (a) multiple segments of the lace where the lace crosses between various lace-receiving elements and (b) end portions of the lace. In addition to utilizing both hands of the wearer, tensioning a lace in some conventional articles of footwear may be time-consuming and relatively difficult for the wearer. An advantage of the lacing system discussed above, however, is the relative quickness and ease with which upper 30 may be tightened around the foot. More particularly, the wearer need only pull on or otherwise place end lengths 61 and 71 in tension to tighten upper 30 around the foot because central lengths 62 and 72 freely slide through lace-receiving elements 41-45 and 51-55 when end lengths 61 and 71 are tensioned. As such, the wearer need not pull on segments of laces 60 and 70 that extend between or pass through lace-receiving elements 41-45 and 51-55 (i.e., central lengths 62 and 72) when securing the foot within footwear 10. Moreover, various individuals (e.g., children, elderly, disabled) may benefit greatly from the relative quickness and ease with which upper 30 may be tightened around the foot with the lacing system.

Further Configurations

Figure 7A:
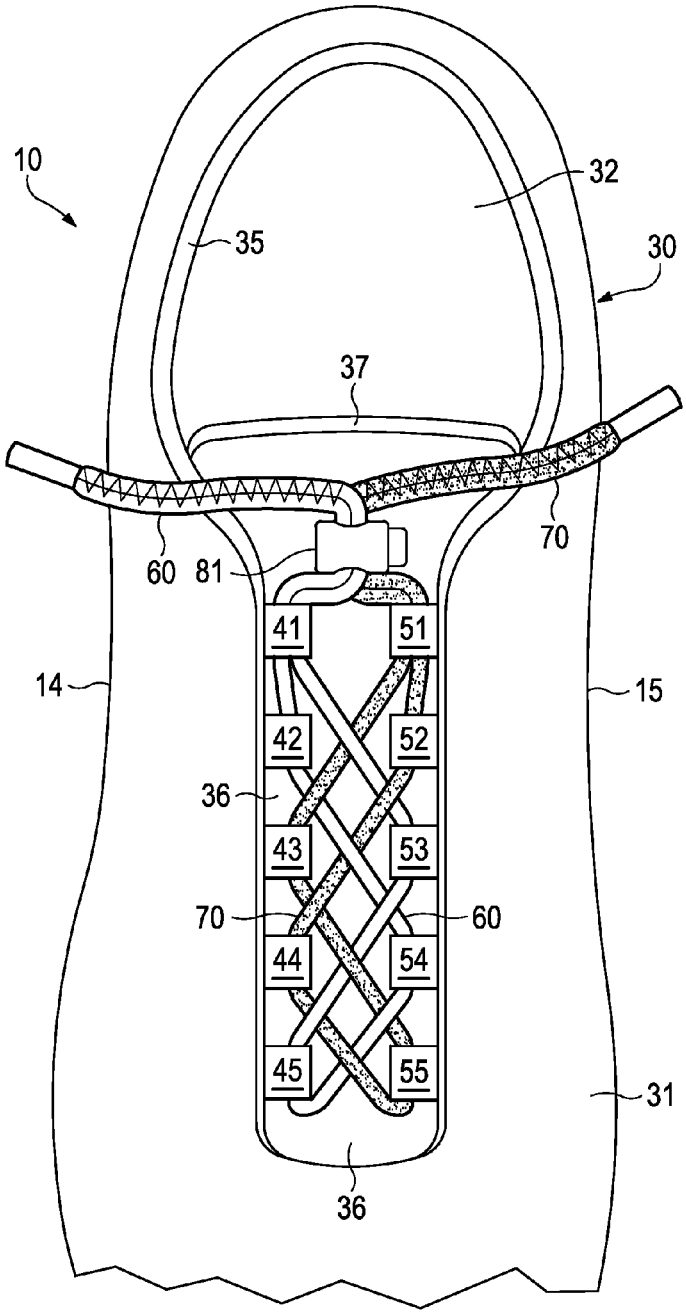
FIGS. 7A-7E are top plan views depicting further configurations of the article of footwear.
Figure 7B:
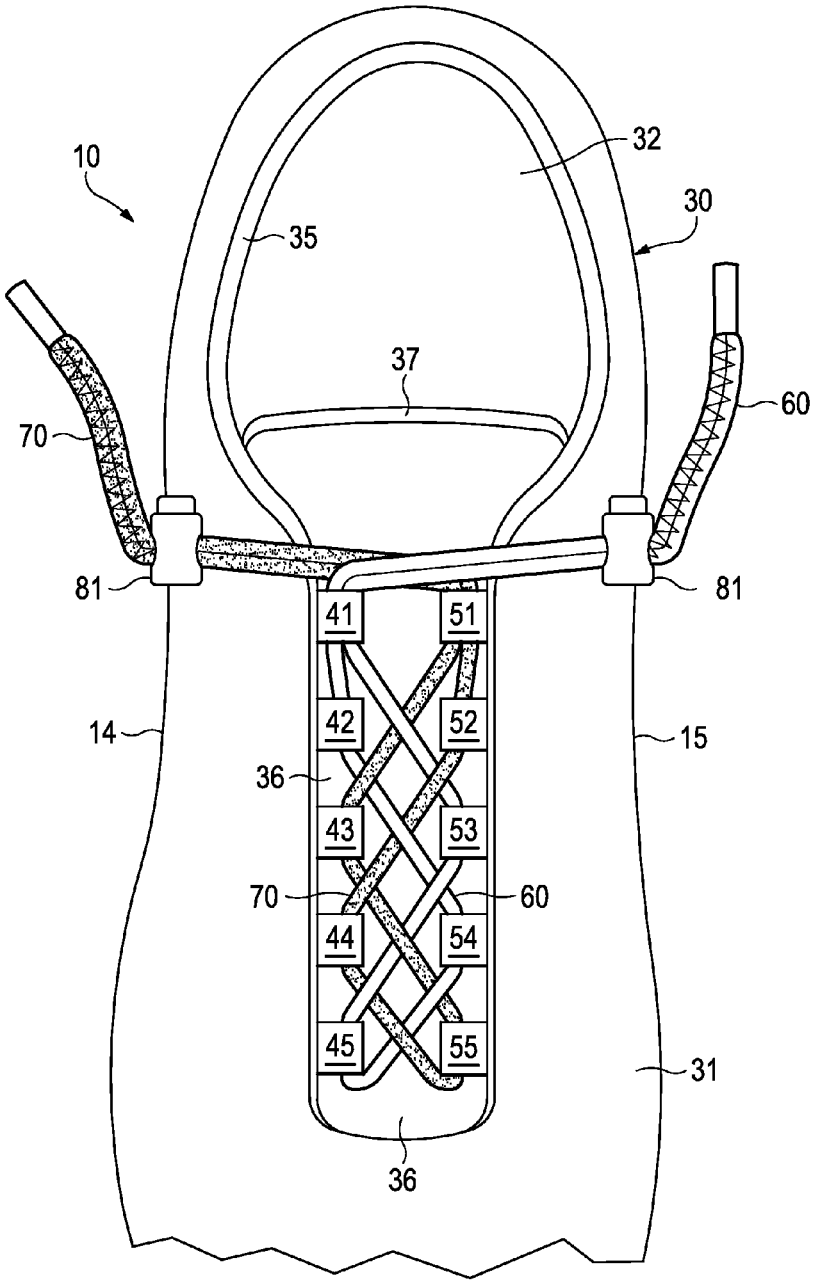

The general configuration discussed above provides an example of various features associated with the lacing system. Many of these features, however, may be modified or otherwise changed, while retaining the advantage of tightening upper 30 around the foot with relative ease. As an example, FIG. 7A depicts the lacing system of footwear 10 as including an adjustable locking device 81, which may have the configuration of a cord lock or other mechanical fastener. Rather than tying laces 60 and 70 together, locking device 81 may be utilized to retain tension in laces 60 and 70 when upper 30 is tightened around the foot. A similar configuration is depicted in FIG. 7B wherein two locking devices 81 are secured to covering element 31 adjacent to ankle opening 35. First lace 60 extends through one locking device 81 and second lace 70 extends through the other locking device 81. In this configuration, each of laces 60 and 70 may be independently tensioned.

Figure 7C:
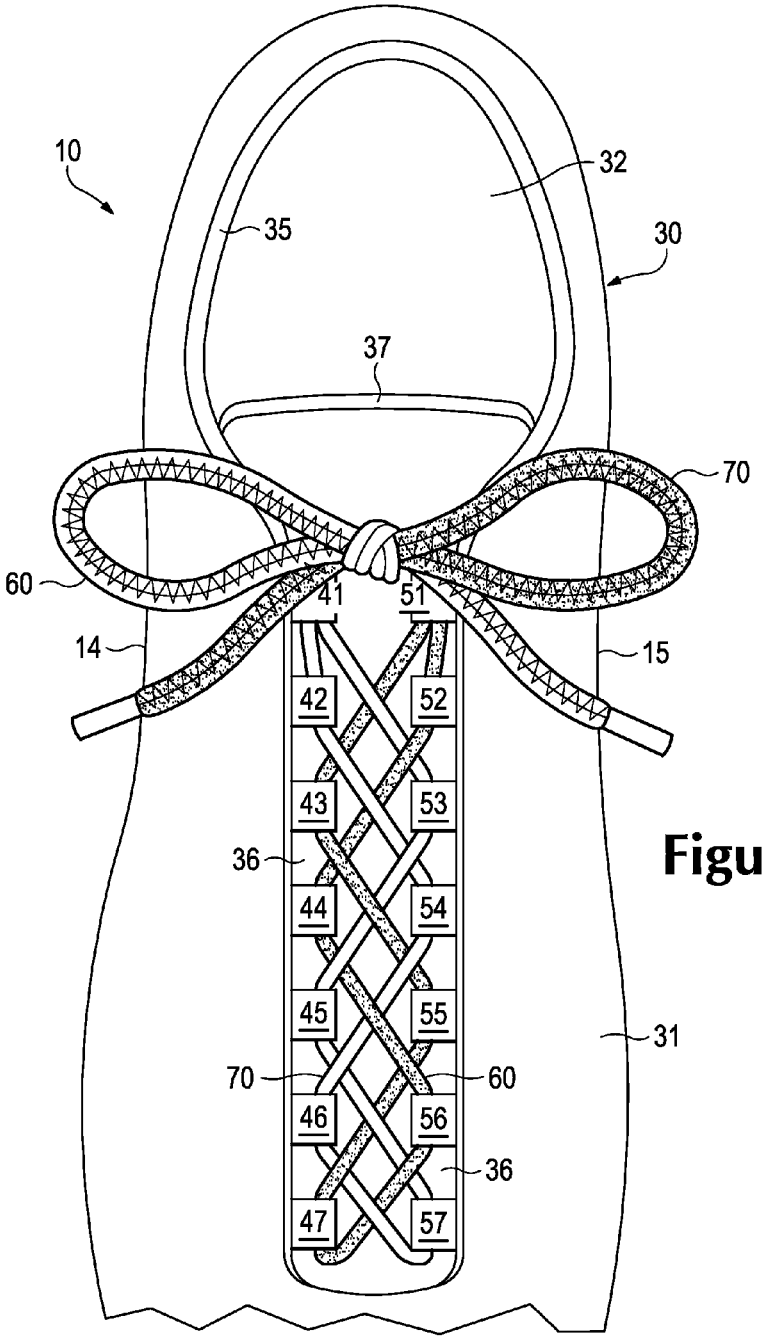

The lacing system discussed above includes five lace-retaining elements 41-45 and five lace retaining elements 51-55. Referring to FIG. 7C, however, footwear 10 is depicted as having a configuration incorporating seven lace-retaining elements 41-47 and seven lace retaining elements 51-57. In this configuration, first lace 60 extends past lace-retaining element 45 and passes through lace-retaining elements 46 and 57, and second lace 70 extends past lace-retaining element 55 and passes through lace-retaining elements 47 and 56. Larger articles of footwear, basketball shoes, and boots, for example, may utilize lacing systems with the additional lace-retaining elements 46, 47, 56, and 57. Moreover, more than seven pairs of lace-receiving elements may be incorporated into further articles of footwear.

Figure 7D:
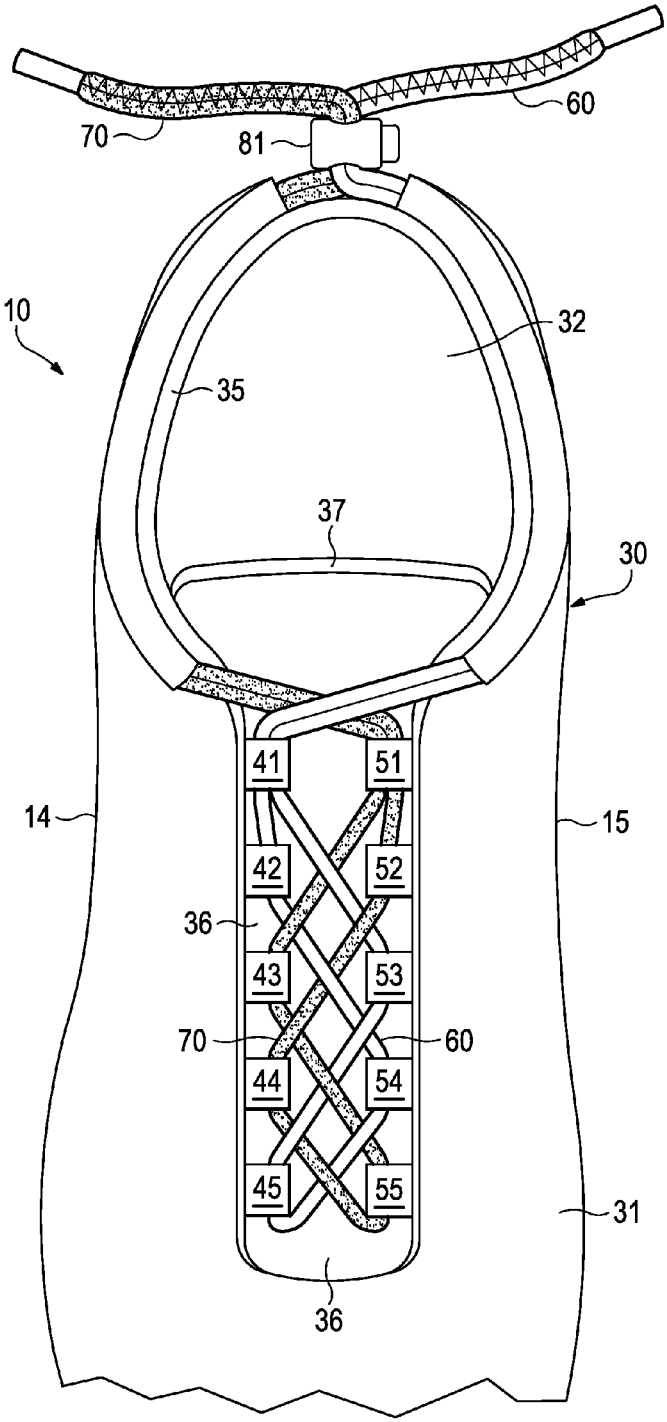

Another configuration of footwear 10 is depicted in FIG. 7D, wherein laces 60 and 70 extend into upper 30 and around ankle opening 35. Laces 60 and 70 exit upper 30 in a rear area of heel region 13, where locking device 81 is located. An advantage to this configuration is that laces 60 and 70 may further tighten ankle opening 35 around upper areas of the foot or the ankle of the wearer.

Figure 7E:
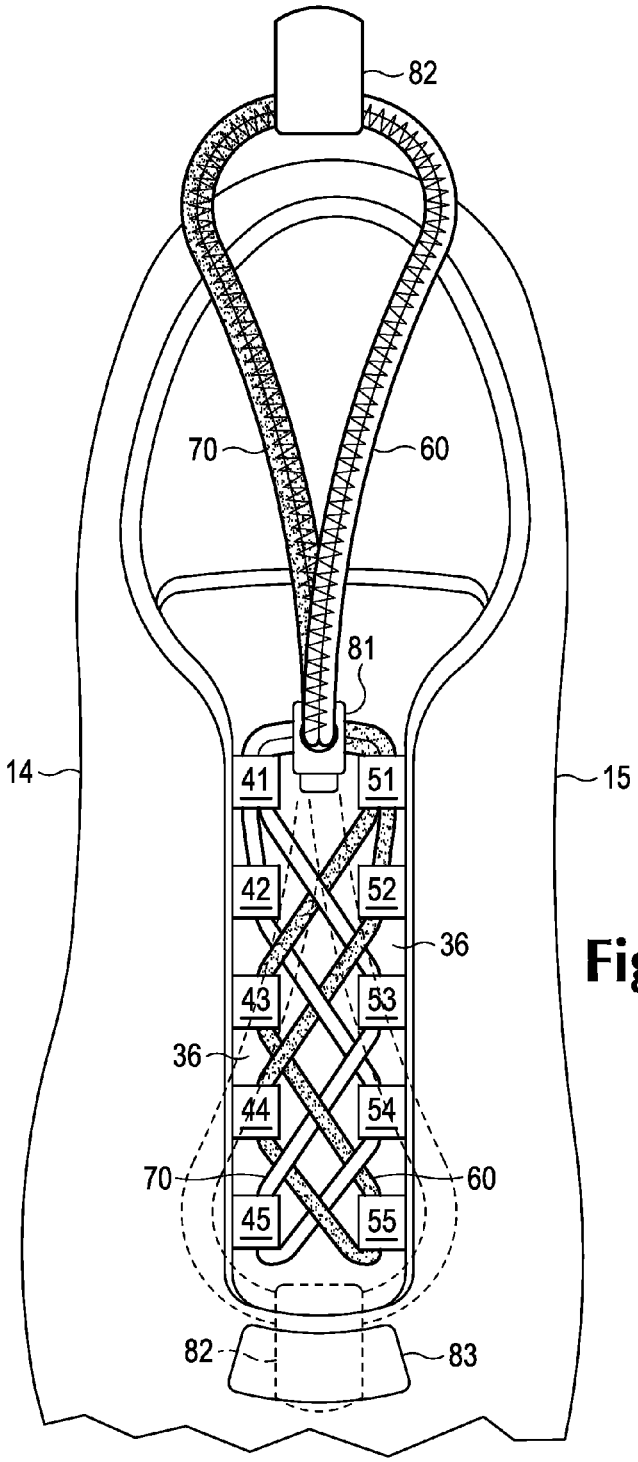

Yet another configuration of footwear 10 is depicted in FIG. 7E. In addition to locking device 81, the lacing system includes a retainer 82 and a securing member 83. Retainer 82 may be, for example, one part of a hook-and-loop fastener that extends around terminal ends 63 and 73. Similarly, securing member 83 may be another part of the hook-and-loop fastener that is secured to covering element 31. Although depicted as being located forward of throat area 36, securing member 83 may be located in various positions on upper 30. In this configuration, locking device 81 may be utilized to retain tension in laces 60 and 70. In order to prevent end lengths 61 and 71 from swinging, flopping, or otherwise moving when footwear 10 is worn, retainer 82 may engage securing member 83 to join the two parts of the hook-and-loop fastener together. Although the hook-and-loop fastener is suitable for retainer 82 and securing member 83, magnetic fasteners, buttons, snaps, and other types of fasteners may also be utilized.

The two parts of the hook-and-loop fastener generally include hooks in a hook part or loops in a loop part, with the hooks engaging the loops to secure the hook part and the loop part together. Although retainer 82 and securing member 83 may include either the hook part or the loop part, footwear 10 gains an advantage when (a) retainer 82 incorporates the loop part and (b) securing member 83 includes the hook part. More particularly, prior to engaging retainer 82 and securing member 83, end lengths 61 and 71 may contact other objects, such as apparel of the wearer or carpeting. If retainer 82 includes the hook part, retainer 82 may become inadvertently joined to one of the other objects. As such, incorporating the loop part into retainer 82 has the advantage of being less likely to engage the other objects.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure, the upper including a lacing system comprising:

a first series of lace-receiving elements extending in a longitudinal direction of the footwear;

a second series of lace-receiving elements extending in the longitudinal direction of the footwear, the second series being spaced from and parallel to the first series;

a first lace that is a single element folded back on itself with a first end length having a first terminal end, a second end length having a second terminal end, and a central length disposed between the first end length and the second end length, wherein the first end length is parallel with and joined to the second end length such that the first end length and the second end length together form a unitary segment of the first lace, the central length having a first segment extending from the point where the first lace folds back on itself to the first end length and a second segment extending from the point where the first lace folds back on itself to the second end length, and wherein the central length is designed specifically to extend through (a) two of the lace-receiving elements of the first series that are consecutive, (b) two of the lace-receiving elements of the second series that are consecutive, (c) wherein the first segment of the central length and the second segment of the central length both extend together through one of the lace-receiving elements; and wherein the first segment and the second segment of the first lace extend through a topmost lace-receiving element of the first series of lace-receiving elements located adjacent to an ankle opening of the upper;

a second lace extending through (a) two of the lace-receiving elements of the second series that are consecutive and (b) two of the lace-receiving elements of the first series that are consecutive;

wherein the second lace is a single element folded back on itself with a first end length having a first terminal end, a second end length having a second terminal end, and a central length disposed between the first end length of the second lace and the second end length of the second lace, wherein the first end length of the second lace is parallel with and joined to the second end length of the second lace such that the first end length of the second lace and the second end length of the second lace together form a unitary segment of the second lace, and wherein the second lace has a first segment extending from the point where the second lace folds back on itself to the first end length and a second segment extending from the point where the first lace folds back on itself to the second end length, the first segment and the second segment of the second lace both extending through one of the lace-receiving elements of the second series;

wherein the first segment and the second segment of the second lace both extend through one of the lace-receiving elements of the second series located adjacent to an ankle opening of the upper.

2. The article of footwear recited in claim 1, wherein the central length of the second lace extends through two consecutive lace-receiving elements of the second series.

3. The article of footwear recited in claim 2, wherein the unitary segment of the first lace and the unitary segment of the second lace are designed to together tie a bow tie.

4. The article of footwear recited in claim 1, wherein the first lace and the second lace extend through an adjustable locking device.

5. The article of footwear recited in claim 1, wherein the unitary segment of the first lace and an end length of the second lace are both secured to a retainer element.

6. The article of footwear recited in claim 5, wherein the retainer element includes a first part of a hook-and-loop fastening system, and a second part of the hook-and-loop fastening system is secured to the upper, the first part being joinable with the second part to secure the unitary segment of the first lace to an end length the second lace.

7. An article of footwear having an upper and a sole structure, the upper including a lacing system comprising:

a first series of lace-receiving elements extending in a longitudinal direction of the footwear and including at least five lace-receiving elements;

a second series of lace-receiving elements extending in the longitudinal direction of the footwear and including at least five lace-receiving elements, the second series being spaced from and substantially parallel with the first series;

a first lace that is a single element folded back on itself with a first end length having a first terminal end, a second end length having a second terminal end, and a central length disposed between the first end length and the second end length, wherein the first end length is parallel with and joined to the second end length such that the first end length and the second end length together form a unitary segment of the first lace, the central length having a first segment extending from the point where the first lace folds back on itself to the first end length and a second segment extending from the point where the first lace folds back on itself to the second end length, the central length is designed specifically to extend through three of the lace-receiving elements of the first series and two of the lace-receiving elements of the second series, wherein the central length extends through a first lace-receiving element of the first series directly to and through a second lace-receiving element that is consecutive with the first lace-receiving element;

wherein the first segment and the second segment of the first lace extend through a topmost lace-receiving element of the first series of lace-receiving elements;

a second lace extending through three of the lace-receiving elements of the second series and two of the lace-receiving elements of the first series; and wherein the second lace is a single element folded back on itself with a first end length having a first terminal end, a second end length having a second terminal end, and a central length disposed between the first end length of the second lace and the second end length of the second lace, wherein the first end length of the second lace is parallel with and joined to the second end length of the second lace such that the first end length of the second lace and the second end length of the second lace together form a unitary segment of the second lace, and wherein the second lace has a first segment extending from the point where the second lace folds back on itself to the first end length and a second segment extending from the point where the first lace folds back on itself to the second end length, the first segment and the second segment of the second lace both extending through one of the lace-receiving elements of the second series;

wherein the first segment and the second segment of the second lace are both designed to extend through one of the lace-receiving elements of the second series located adjacent to an ankle opening of the upper.

8. The article of footwear recited in claim 7, wherein the unitary segment of the first lace has a length sufficient to form a bow tie.

9. The article of footwear recited in claim 7, wherein at least one of the lace-receiving elements of the first series has a tubular structure with an axis extending in the longitudinal direction of the footwear.

10. The article of footwear recited in claim 7, wherein the central length of the first lace extends through a bottommost lace-receiving element of the first series with respect to the other lace-receiving elements of the first series and the central length of the second lace extends through a bottommost lace-receiving element of the second series with respect to the other lace-receiving elements of the second series.

11. The article of footwear recited in claim 7, wherein the first lace and the second lace extend through an adjustable locking device.

12. The article of footwear recited in claim 7, wherein the unitary segment of the first lace and an end length of the second lace are both secured to a retainer element that includes a first part of a hook-and-loop fastening system, and a second part of the hook-and-loop fastening system is secured to the upper, the first part being joinable with the second part to secure the unitary segment of the first lace and the end length of the second lace.

13. An article of footwear having an upper and a sole structure, the upper including a lacing system comprising:

a plurality of lace-receiving elements extending through a throat area of the upper, the lace-receiving elements including (a) a first series of lace-receiving elements having a first topmost lace-receiving element positioned adjacent to an ankle opening of the upper and (b) a second series of lace-receiving elements having a second topmost lace-receiving element that is positioned adjacent to the ankle opening, wherein the second series of lace-receiving elements is spaced from and parallel to the first series of lace-receiving elements;

a first lace that is a single element folded back on itself with a first end length having a first terminal end, a second end length having a second terminal end, and a central length disposed between the first end length and the second end length, wherein the first end length is parallel with and joined to the second end length such that the first end length and the second end length together form a unitary segment of the first lace, the central length having a first segment extending from the point where the first lace folds back on itself to the first end length and a second segment extending from the point where the first lace folds back on itself to the second end length, the first lace extending through a portion of the lace-receiving elements, and the first segment and the second segment of the first lace both extending together through the first lace-receiving element; and a second lace that is a single element folded back on itself with a first end length having a first terminal end, a second end length having a second terminal end, and a central length disposed between the first end length and the second end length, wherein the first end length is parallel with and joined to the second end length such that the first end length and the second end length together form a unitary segment of the second lace, the central length having a first segment extending from the point where the first lace folds back on itself to the first end length and a second segment extending from the point where the first lace folds back on itself to the second end length, the second lace extending through another portion of the lace-receiving elements, and the first segment and the second segment of the second lace both designed to extend together through the second lace-receiving element.

14. The article of footwear recited in claim 13, wherein the unitary segment formed by the first end length and the second end length of the first lace is designed to be tied into a bow with the unitary segment formed by the first end length and the second end length of the second lace.

15. The article of footwear recited in claim 13, wherein the first lace and the second lace extend through an adjustable locking device.

16. The article of footwear recited in claim 13, wherein at least one of the lace-receiving elements has a tubular structure with an axis extending in a longitudinal direction of the footwear.

17. The article of footwear recited in claim 13, wherein the first lace and the second lace both have end lengths secured to a retainer element that includes a first part of a hook-and-loop fastening system, and a second part of the hook-and-loop fastening system is secured to the upper, the first part being joinable with the second part to secure the ends of the first lace and the second lace.

18. An article of footwear having an upper and a sole structure, the upper including a lacing system comprising:

a lateral series of lace-receiving elements, the lateral series being located in a lateral portion of the footwear, and the lateral series including:

(a) a first lateral lace-receiving element that is the topmost lace-receiving element of the lateral series and is positioned proximal to an ankle opening of the upper, (b) a second lateral lace-receiving element positioned forward of the first lateral lace-receiving element, (c) a third lateral lace-receiving element positioned forward of the second lateral lace-receiving element, (d) a fourth lateral lace-receiving element positioned forward of the third lateral lace-receiving element, and (e) a fifth lateral lace-receiving element positioned forward of the fourth lateral lace-receiving element;

a medial series of lace-receiving elements, the medial series being located in a medial portion of the footwear, and the medial series including:

(a) a first medial lace-receiving element that is the topmost lace-receiving element of the medial series and is positioned proximal to an ankle opening of the upper, (b) a second medial lace-receiving element positioned forward of the first medial lace-receiving element, (c) a third medial lace-receiving element positioned forward of the second medial lace-receiving element, (d) a fourth medial lace-receiving element positioned forward of the third medial lace-receiving element, and (e) a fifth medial lace-receiving element positioned forward of the fourth medial lace-receiving element;

a first lace that is a single element folded back on itself with a first end length having a first terminal end, a second end length having a second terminal end, and a central length disposed between the first end length and the second end length, wherein the first end length is parallel with and joined to the second end length such that the first end length and the second end length together form a unitary segment of the first lace, the central length having a first segment extending from the point where the first lace folds back on itself to the first end length and a second segment extending from the point where the first lace folds back on itself to the second end length, the first lace being specifically designed to extend consecutively through the first lateral lace-receiving element, the second lateral lace-receiving element, the fourth medial lace-receiving element, the fifth lateral lace-receiving element, the third medial lace-receiving element, and the first lateral lace-receiving element, wherein the first segment and the second segment of the central length both extend together through the first lateral lace-receiving element; and a second lace that is a single element folded back on itself with a first end length having a first terminal end, a second end length having a second terminal end, and a central length disposed between the first end length and the second end length, wherein the first end length is parallel with and joined to the second end length such that the first end length and the second end length together form a unitary segment of the second lace, the central length having a first segment extending from the point where the first lace folds back on itself to the first end length and a second segment extending from the point where the first lace folds back on itself to the second end length, the second lace being designed specifically to extend consecutively through the first medial lace-receiving element, the second medial lace-receiving element, the fourth lateral lace-receiving element, the fifth medial lace-receiving element, the third lateral lace-receiving element, and the first medial lace-receiving element, wherein the first segment and the second segment of the second lace both extend together through the first medial lace-receiving element.

* * * * *